US011739901B2

(12) United States Patent
Dressler et al.

(10) Patent No.: US 11,739,901 B2
(45) Date of Patent: Aug. 29, 2023

(54) PROJECTION HEADLIGHT FOR VEHICLES WITH LIGHT GUIDES FORMED TO IMAGE TO DIFFERENT SUB-LIGHT DISTRIBUTIONS

(71) Applicant: Hella GmbH & Co. KGaA, Lippstadt (DE)

(72) Inventors: Bjoern Dressler, Menden (DE); Franz-Josef Kalze, Harsewinkel (DE); Ronny Letzin, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/574,317

(22) Filed: Jan. 12, 2022

(65) Prior Publication Data

US 2022/0136673 A1 May 5, 2022

Related U.S. Application Data

(63) Continuation of application No. PCT/EP2020/068236, filed on Jun. 29, 2020.

(30) Foreign Application Priority Data

Jul. 12, 2019 (DE) ..... 10 2019 118 968.3

(51) Int. Cl.
*F21S 41/24* (2018.01)
*F21S 41/657* (2018.01)
(Continued)

(52) U.S. Cl.
CPC ..... *F21S 41/657* (2018.01); *F21S 41/143* (2018.01); *F21S 41/151* (2018.01); *F21S 41/19* (2018.01);
(Continued)

(58) Field of Classification Search
CPC ..... F21S 41/143; F21S 41/24; F21S 41/25; F21S 41/255; F21S 41/322; F21S 41/43
See application file for complete search history.

(56) References Cited

U.S. PATENT DOCUMENTS 9,249,943 B2 2/2016 Hossfeld et al.
9,664,847 B2 5/2017 Krenn et al.
(Continued)

FOREIGN PATENT DOCUMENTS

AT 512865 A1 11/2013
AT 513816 A1 7/2014
(Continued)

OTHER PUBLICATIONS

CN 2019 21088179.5, filed Jul. 11, 2019, foreign priority document of Zhou et al. 20210364144 (Year: 2019).*
(Continued)

*Primary Examiner* — Andrew J Coughlin
*Assistant Examiner* — Steven Y Horikoshi
(74) *Attorney, Agent, or Firm* — Muncy, Geissler, Olds & Lowe, P.C.

(57) ABSTRACT

A projection headlight for vehicles, having a first lighting unit containing a light source and a primary optical unit for pre-shaping light exiting the light source, a second lighting unit containing a light source and a primary optical unit for pre-shaping the light exiting the light source, a secondary optical unit for imaging the light exiting the primary optical unit of the first lighting unit in a region in front of the vehicle as a first light distribution and light exiting the primary optical unit of the second lighting unit as a second light distribution, an actuator for actuating the first lighting unit and the second lighting unit in order to generate the light distribution consisting of the first light distribution and the second light distribution, a diaphragm with a diaphragm
(Continued)

edge for producing a light-dark boundary in the first light distribution.

12 Claims, 3 Drawing Sheets

(51) Int. Cl.

| | |
|---|---|
| ***F21S 41/32*** | (2018.01) |
| ***F21S 41/143*** | (2018.01) |
| ***F21S 41/255*** | (2018.01) |
| ***F21S 41/19*** | (2018.01) |
| ***F21S 41/43*** | (2018.01) |
| ***F21S 41/151*** | (2018.01) |

(52) U.S. Cl.
CPC ..... *F21S 41/24* (2018.01); *F21S 41/255* (2018.01); *F21S 41/322* (2018.01); *F21S 41/43* (2018.01)

(56) References Cited

U.S. PATENT DOCUMENTS

| | | | | |
|---|---|---|---|---|
| 9,816,678 | B2 | 11/2017 | Krenn | |
| 10,900,630 | B2 | 1/2021 | Dikau et al. | |
| 11,098,870 | B2 | 8/2021 | Garin et al. | |
| 11,274,802 | B2 | 3/2022 | Dressler | |
| 2012/0039083 | A1* | 2/2012 | Meyrenaud | F21S 41/663 362/516 |
| 2014/0321141 | A1* | 10/2014 | Bauer | F21S 41/321 362/235 |
| 2016/0265732 | A1 | 9/2016 | Jacquemin et al. | |
| 2018/0216794 | A1* | 8/2018 | Marchal | F21S 41/36 |
| 2019/0226658 | A1* | 7/2019 | Kawai | F21S 41/151 |
| 2020/0072428 | A1* | 3/2020 | Simchak | F21S 41/255 |
| 2021/0364144 | A1* | 11/2021 | Zhou | F21S 41/43 |

FOREIGN PATENT DOCUMENTS

| | | | | |
|---|---|---|---|---|
| CN | 107448867 | A | 12/2017 | |
| DE | 102017213103 | A1 | 1/2019 | |
| DE | 102018110793 | A1 | 11/2019 | |
| EP | 2034235 | A1 | 3/2009 | |
| EP | 2799761 | A2 | 11/2014 | |
| EP | 3489576 | A1 | 5/2019 | |
| FR | 3065785 | A1 | 11/2018 | |
| WO | WO-2017198516 | A1 * | 11/2017 | F21S 41/143 |
| WO | WO2017198516 | A1 | 11/2017 | |

OTHER PUBLICATIONS

Machine translation of CN 2019 21088179.5 (Year: 2022).*
Dictionary definition of actuator, retrieved from dictionary.cambridge.org on Dec. 7, 2022 (Year: 2022).*
Machine translation of WO-2017198516-A1, retrieved from worldwide.espacenet.com on Dec. 7, 2022 (Year: 2022).*
U.S. Appl. No. 62/787,087, filed Sep. 5, 2018, priority document of US PGPub 2020/0072428 A1) (Year: 2018).*
International Search Report dated Oct. 7, 2020 in corresponding application PCT/EP2020/068236.

* cited by examiner

PROJECTION HEADLIGHT FOR VEHICLES WITH LIGHT GUIDES FORMED TO IMAGE TO DIFFERENT SUB-LIGHT DISTRIBUTIONS

This nonprovisional application is a continuation of International Application No. PCT/EP2020/068236, which was filed on Jun. 29, 2020, and which claims priority to German Patent Application No. 10 2019 118 968. 3, which was filed in Germany on Jul. 12, 2019, and which are both herein incorporated by reference.

BACKGROUND OF THE INVENTION

Field of the Invention

The present invention relates to a projection headlight for vehicles, comprising a first lighting unit containing a light source and a primary optical unit for pre-shaping light exiting the light source, a second lighting unit containing a light source and a primary optical unit for pre-shaping the light exiting the light source, a secondary optical unit for imaging the light exiting the primary optical unit of the first lighting unit in a region in front of the vehicle as a first light distribution and light exiting the primary optical unit of the second lighting unit as a second light distribution, an actuator for actuating the first lighting unit and the second lighting unit in order to generate the light distribution consisting of the first light distribution and the second light distribution, a diaphragm with a diaphragm edge for producing a light-dark boundary in the first light distribution.

Description of the Background Art

From EP 2 034 235 A1, which is incorporated herein by reference, a projection headlight for vehicles is known, which comprises a first lighting unit containing a light source and a primary optical unit for pre-shaping the light exiting the light source, and a second lighting unit containing a light source and a primary optical unit for pre-shaping the light exiting the light source. The projection headlight also has a diaphragm with a diaphragm edge for producing a light-dark boundary and a secondary optical unit, so that the light exiting the first lighting unit leads to a first light distribution, for example a dipped beam distribution with a defined light-dark boundary. The light exiting the second lighting unit is imaged by the secondary optical unit to a second light distribution. The primary optical units of the first and second lighting units are designed as reflectors, which must redirect the light of the light sources oriented transversely to a main beam direction of the projection headlight in the direction of the upstream secondary optical unit. A disadvantage of the projection headlight is that due to the indirect light deflection by the reflectors, only a limited luminous flux can be used to produce the light distribution.

The German patent application 10 2018 110 793, which corresponds to US 2021/0080072, which is incorporated herein by reference, discloses a projection headlight for vehicles comprising a first lighting unit containing a light source and a primary optical unit as well as a second lighting unit containing a light source and a primary optical unit, which are paired with separate lenses as secondary optical units. The primary optical units of the lighting units as well as a diaphragm with a diaphragm edge for producing a light-dark boundary of a light distribution are connected to each other in one piece, so that a projection headlight can be provided with the greatest possible avoidance of manufacturing and assembly tolerances. It is true that a high luminous flux or high luminous efficacy can be provided by the arrangement of the light sources and the formation of the primary optical units as light guide elements.

In the conventional art, however, a secondary optical unit consists of several lens elements, which require increased production effort and installation space.

SUMMARY OF THE INVENTION

It is therefore an object of the present invention to provide a projection headlight for vehicles in such a way that the highest possible luminous flux is generated in a space-saving manner to generate different light distributions, wherein in particular both the manufacturing and assembly tolerances can be kept as low as possible.

To achieve this object, the invention provides in an exemplary embodiment that the primary optical unit of the first lighting unit and/or the second lighting unit comprises a plurality of light guide elements which are designed to be formed differently such that the light exiting the light guide elements is imaged into different sub-light distributions of the first light distribution or the second light distribution by a secondary optical unit paired with the first lighting unit and the second lighting unit.

An advantage of the invention is that different light distributions with a relatively high luminous efficacy can be provided with the greatest possible avoidance of manufacturing and assembly tolerances, wherein a secondary optical unit is formed by a component that is paired with all lighting units. The basic idea of the invention is to combine the partial luminous flux produced by the lighting units or primary optical units of the lighting units into one light channel, which is imaged by the secondary optical unit into a plurality of sub-light distributions or light distributions, so that by superimposition of the sub-light distributions or light distributions, the predetermined resulting light distribution is generated. The primary optical units of the lighting units, which are designed as light guide elements, are formed in such a way that the corresponding sub-light distributions or light distributions are generated by the same secondary optical unit. The invention thus enables a compact and bright projection headlight.

The secondary optical unit can be designed as a lens (single lens) which is upstream of the first and second lighting units. If, in particular, the first and second lighting units are arranged vertically on top of each other, then depending on the actuation of the light sources of the first and second lighting units, a combined dipped beam/high beam distribution can be generated.

The primary optical units of the first and second lighting units can be connected to the diaphragm in one piece, so that the tolerance chain of the components is shortened.

The secondary optical unit can be formed as a converging lens with a single optical axis, which runs in the main beam direction of the projection headlight. The primary optical unit of the first and second lighting units is thus aligned with the converging lens.

The primary optical units of the first and second lighting units and the diaphragm can be formed as a structural unit produced by injection molding. Advantageously, the manufacturing costs can be reduced in this way.

The extension of the primary optical units of the first and/or second lighting unit in the direction of light guidance or in the main beam direction may be less than half an extension of the diaphragm in the same direction. The primary optical unit thus has a relatively short installation depth, so that light decoupling surfaces of the primary optical unit can direct the coupled light more precisely.

The primary optical unit of the first lighting unit can be arranged in a vertical direction above the primary optical unit of the second lighting unit. The first lighting unit is used to generate a first light distribution as a basic light distribution, which is essentially arranged below a horizontal zero line. The primary optical unit of the second lighting unit is used to produce a second range light distribution, which is essentially arranged above the horizontal zero line. Advantageously, the projection headlight is thus compactly designed as a projection light module.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

A projection headlight for vehicles is installed in the front region of a vehicle. The projection headlight has a housing within which the optical components described below are arranged. An opening of the housing is closed by a transparent cover.

Figure 1:
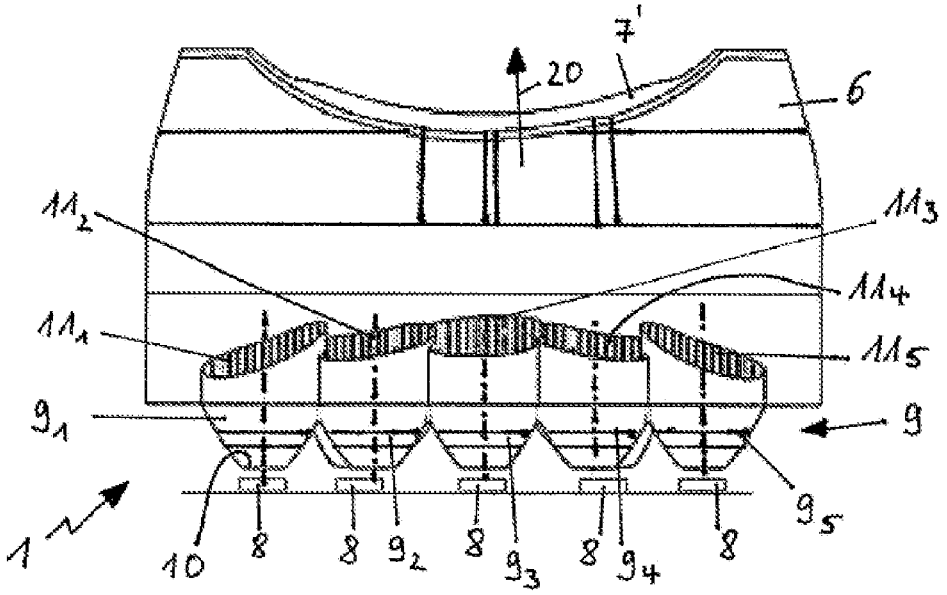
FIG. 1 is a plan view of a projection headlight according to an embodiment of the invention.
Figure 2:
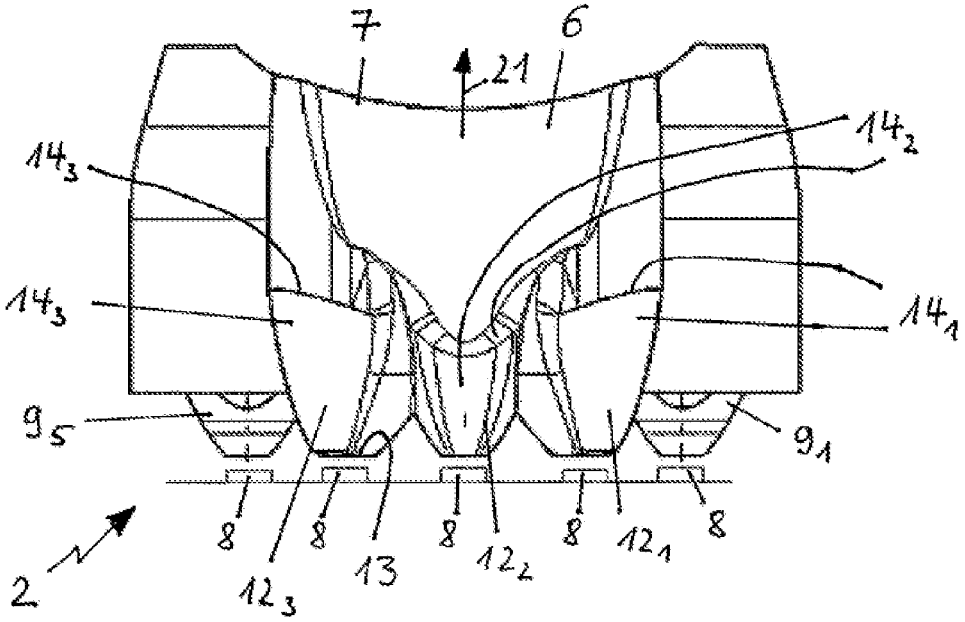
FIG. 2 is a bottom view of the projection headlight.
Figure 3:
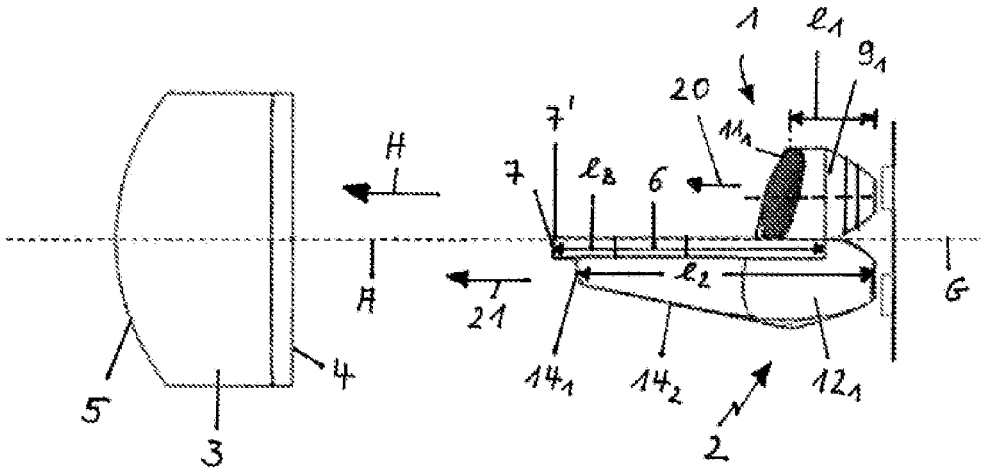
FIG. 3 is a side view of the projection headlight.

According to an example embodiment of the invention according to FIGS. 1 to 3, the projection headlight has a first lighting unit 1 and a second lighting unit 2, which are paired with a common secondary optical unit 3, which is arranged in the main beam direction H in front of the first lighting unit 1 and the second lighting unit 2.

The secondary optical unit 3 is designed as a lens with a single optical axis A. The lens 3 is formed as a converging lens, in particular as a plano-convex lens, wherein a flat surface 4 of the lens 3 serves as a light entry surface and a convex surface 5 of the lens 3 serves as a light exit surface. Alternatively, the lens 3 may also be biconvex or have another lens geometry.

The optical axis A of the secondary optical unit 3 runs in a horizontal interface G, which connects the first lighting unit 1 with the second lighting unit 2 and/or in which a diaphragm 6 comprising a front diaphragm edge 7' in the main beam direction H runs. The diaphragm edge 7' of the diaphragm 6 is located in a focal point of the lens 3.

Figure 4:
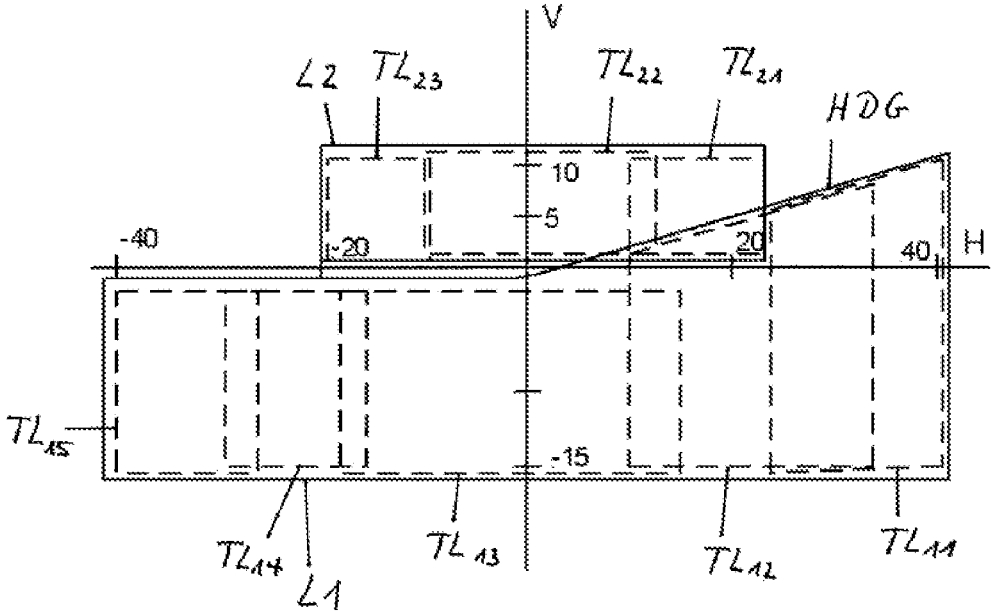
FIG. 4 is a schematic view of a light distribution on a measuring wall at a 25 m distance, which is generated by the projection headlight according to the invention.

The first lighting unit 1 is arranged above the interface G or the optical axis A and has a plurality of light sources 8 and a plurality of primary optical units 9. In the present embodiment, the first lighting unit 1 has five primary optical units $\mathbf{9}_1$, $\mathbf{9}_2$, $\mathbf{9}_3$, $\mathbf{9}_4$, $\mathbf{9}_5$, which are arranged next to each other in the horizontal direction. The primary optical units $\mathbf{9}_1$, $\mathbf{9}_2$, $\mathbf{9}_3$, $\mathbf{9}_4$, $\mathbf{9}_5$, are each paired with a separate light source 8. The primary optical units $\mathbf{9}_1$, $\mathbf{9}_2$, $\mathbf{9}_3$, $\mathbf{9}_4$, $\mathbf{9}_5$, are each designed as light guide elements, which have a light coupling surface 10 facing the light source (8) and light decoupling surfaces ($\mathbf{11}_1$, $\mathbf{11}_2$, $\mathbf{11}_3$, $\mathbf{11}_4$, $\mathbf{11}_5$) on a side facing away from the light source. The light decoupling surfaces $\mathbf{11}_1$, $\mathbf{11}_2$, $\mathbf{11}_3$, $\mathbf{11}_4$, $\mathbf{11}_5$ are shaped to be different, so that with appropriate actuation or activation of the light sources 8 of the first lighting unit 1, decoupled light 20 is produced by the lens 3 to generate different sub-light distributions $TL_{12}$, $TL_{13}$, $TL_{14}$, $TL_{15}$, which by superimposition form a first light distribution $L_1$ generated by the first lighting unit 1. The light coupling surfaces 10 of the primary optical units $\mathbf{9}_1$, $\mathbf{9}_2$, $\mathbf{9}_3$, $\mathbf{9}_4$, $\mathbf{9}_5$, are preferably equally formed. When switching on all light sources 8 of the first lighting unit 1, a dipped beam distribution $L_1$ is thus displayed on the measuring screen according to FIG. 4 by means of the secondary optical unit 3. The sub-light distributions $TL_{11}$, $TL_{12}$, $TL_{13}$, $TL_{14}$, $TL_{15}$ overlap into the dipped beam distribution $L_1$. The diaphragm edge 7 is imaged into a light-dark boundary HDG of the dipped beam distribution $L_1$.

In the vertical direction below the first lighting unit 1, the second lighting unit 2 is arranged, which has a plurality of primary optical units $\mathbf{12}_1$, $\mathbf{12}_2$, $\mathbf{12}_3$, each of which is paired with a light source 8. The primary optical units $\mathbf{12}_1$, $\mathbf{12}_2$, $\mathbf{12}_3$, of the second lighting unit 2 are designed as light guide elements, each of which has a light coupling surface 13 and a light deflection surface $\mathbf{14}_1$, $\mathbf{14}_2$, $\mathbf{14}_3$ facing the light source 8. The light deflection surfaces $\mathbf{14}_1$, $\mathbf{14}_2$, $\mathbf{14}_3$ of the primary optical units $\mathbf{12}_1$, $\mathbf{12}_2$, $\mathbf{12}_3$, are each formed by a lateral surface of the primary optical units $\mathbf{12}_1$, $\mathbf{12}_2$, $\mathbf{12}_3$, which transmits the light 21 coupled into the primary optical units $\mathbf{12}_1$, $\mathbf{12}_2$, $\mathbf{12}_3$, by total reflection in a longitudinal direction of light guidance, which in the present case coincides with the main beam direction H, so that in the region of a front side of the primary optical units $\mathbf{12}_1$, $\mathbf{12}_2$, $\mathbf{12}_3$, and/or of the diaphragm 6 the coupled light 21 is decoupled. In the present embodiment, the coupled light 21 is exclusively decoupled at a front 7 of the diaphragm 6 formed as a light decoupling surface. The light 21 decoupled at the front 7 of the diaphragm 6 will be imaged by means of the secondary optical unit 3 into sub-light distributions $TL_{21}$, $TL_{22}$, $TL_{23}$, wherein these sub-light distributions overlap into a second light distribution $L_2$.

The second light distribution $L_2$ of the second lighting unit 2 thus serves as a range light distribution, whereas the light distribution $L_1$ of the first lighting unit 1 serves as a basic light distribution. When the light sources 8 of the first lighting unit 1 and the second lighting unit 2, for which the assembly according to the invention has an actuator for actuating, are switched on, the first light distribution $L_1$ and the second light distribution $L_2$ are superimposed into a high beam distribution.

Depending on the formation or design of the light decoupling surfaces $\mathbf{11}_1$, $\mathbf{11}_2$, $\mathbf{11}_3$, $\mathbf{11}_4$, $\mathbf{11}_5$ or the light deflection surfaces $\mathbf{14}_1$, $\mathbf{14}_2$, $\mathbf{14}_3$, sub-light distributions $TL_{11}$, $TL_{12}$, $TL_{13}$, $TL_{14}$, $TL_{15}$, are thus produced, wherein adjacent sub-light distributions overlap. Alternatively, the light decoupling surfaces $\mathbf{11}_1$, $\mathbf{11}_2$, $\mathbf{11}_3$, $\mathbf{11}_4$, $\mathbf{11}_5$ may also be designed in such a way that adjacent sub-light distributions $TL_{11}$, $TL_{12}$, $TL_{13}$, $TL_{14}$, $TL_{15}$, are directly adjacent to each other.

Identical components or component functions are provided with the same reference signs.

FIG. 3 shows that primary optical units $\mathbf{12}_1$, $\mathbf{12}_2$, $\mathbf{12}_3$ of the second lighting unit 2 have a relatively large extension in the main beam direction H, i.e., a relatively large horizontal length $I_2$ as compared to the horizontal length of the primary optical units $\mathbf{9}_1$, $\mathbf{9}_2$, $\mathbf{9}_3$, $\mathbf{9}_4$, $\mathbf{9}_5$. The total light deflection surface $\mathbf{14}_1$, $\mathbf{14}_2$, $\mathbf{14}_3$ of the primary optical units $\mathbf{12}_1$, $\mathbf{12}_2$, $\mathbf{12}_3$ extends to a front region of the diaphragm 6, in which the light exit surface 7 with the diaphragm edge 7' is located. The length $I_1$ of the primary optical units $\mathbf{9}_1$, $\mathbf{9}_2$, $\mathbf{9}_3$, $\mathbf{9}_4$, $\mathbf{9}_5$, of the first lighting unit 1 is less than half a length $I_B$ of the diaphragm 6, whereas the length $I_2$ of the primary optical units $\mathbf{12}_1$, $\mathbf{12}_2$, $\mathbf{12}_3$ is greater than half the length $I_B$ of the diaphragm 6 or the distance between the light decoupling surface 7 and the light sources 8 or light coupling surfaces 10, 13.

The light sources 8 are preferably designed as LED light sources, which are preferably arranged in a vertical common plane. Accordingly, the light coupling surfaces 10, 13 of the first lighting unit 1 and of the second lighting unit 2 are also arranged in the same vertical plane.

The diaphragm 6 and primary optical units $\mathbf{9}_1$, $\mathbf{9}_2$, $\mathbf{9}_3$, $\mathbf{9}_4$, $\mathbf{9}_5$, and primary optical units $\mathbf{12}_1$, $\mathbf{12}_2$, $\mathbf{12}_3$ of the first lighting unit 1 and the second lighting unit 2 are connected to each other in one piece. They are made by injection molding.

Figure 5:
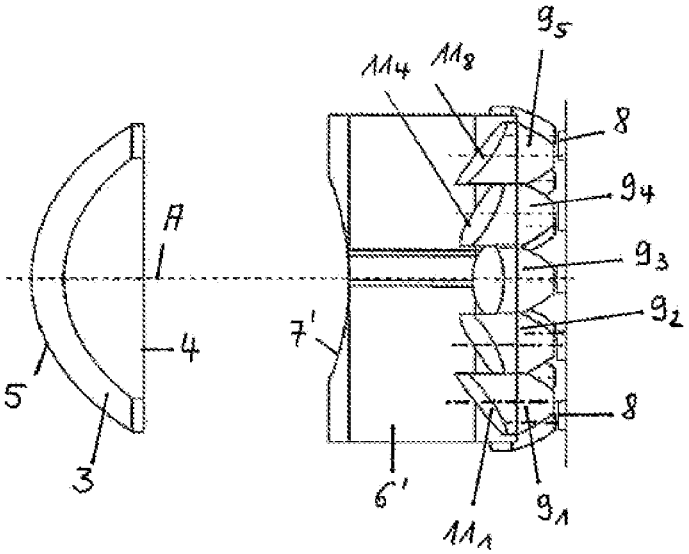
FIG. 5 is a plan view of a projection headlight according to an embodiment of the invention and FIG. 6 is a side view of the projection headlight according to FIG. 5.
Figure 6:
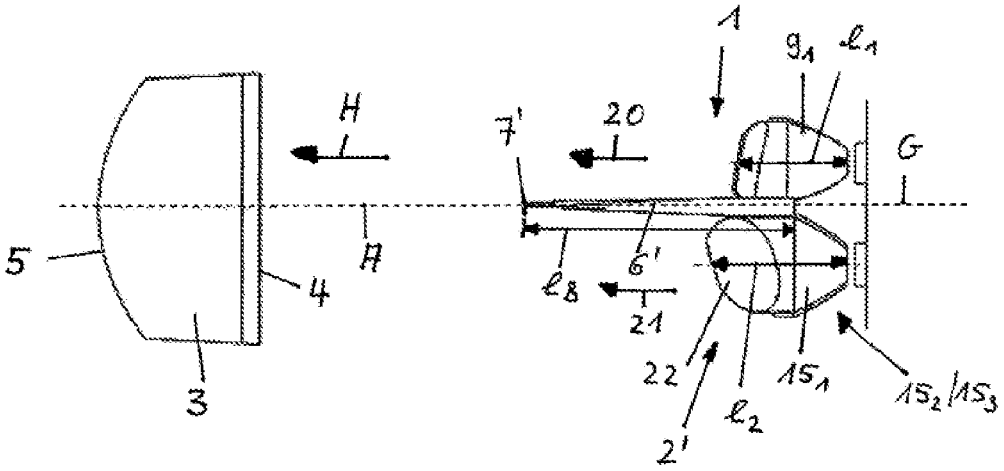

According to an example embodiment in accordance with FIGS. 5 and 6, a projection headlight is provided which differs from the projection headlight in accordance with FIGS. 1 to 3 in that it has a different second lighting unit 2' and a different diaphragm 6'.

The second lighting unit 2' has primary optical units $\mathbf{15}_1$, $\mathbf{15}_2$, $\mathbf{15}_3$, of which the extension in the main beam direction H or of which the horizontal length $I_2'$ is less than half the length $I_B$ of the diaphragm 6'. The dimension of the primary optical units $\mathbf{15}_1$, $\mathbf{15}_2$, $\mathbf{15}_3$ of the second lighting unit 2' is thus comparable to the primary optical units $\mathbf{9}_1$, $\mathbf{9}_2$, $\mathbf{9}_3$, $\mathbf{9}_4$, $\mathbf{9}_5$, of the first lighting unit 1. The primary optical units $\mathbf{15}_1$, $\mathbf{15}_2$, $\mathbf{15}_3$ each have lateral surfaces or light deflection surfaces for total reflection of the coupled light 21 as well as light decoupling surfaces 22, just like each of the primary optical units $\mathbf{9}_1$, $\mathbf{9}_2$, $\mathbf{9}_3$, $\mathbf{9}_4$, $\mathbf{9}_5$.

The diaphragm 6' is tapered in the main beam direction H while forming the diaphragm edge 7'.

The diaphragm 6' is inserted as a finished component in a molding tool of an injection molding machine as an insert and subsequently overmolded by plastic mass for the formation of the primary optical units $\mathbf{9}_1$, $\mathbf{9}_2$, $\mathbf{9}_3$, $\mathbf{9}_4$, $\mathbf{9}_5$, of the first lighting unit 1 and the primary optical units $\mathbf{15}_1$, $\mathbf{15}_2$, $\mathbf{15}_3$ of the second lighting unit 2'. The first lighting unit 1 and the second lighting unit 2' as well as the diaphragm 6' are also—as in the first embodiment—made in one piece or as a single-piece component.

The primary optical units $\mathbf{15}_1$, $\mathbf{15}_2$, $\mathbf{15}_3$ of the second lighting unit 2' have light decoupling surfaces 16 such that, with appropriate actuation of the light sources 8, the sub-light distributions $TL_{21}$, $TL_{22}$, $TL_{23}$ are generated by the converging lens.

There may also be a different number of primary optical units of the first lighting unit 1 and of the second lighting unit 2, 2'.

The diaphragm 6, 6' is coated with a reflective material, for example evaporated with a reflecting surface.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A projection headlight for vehicles, the projection headlight comprising:

a first lighting unit comprising a light source and a primary optical unit for pre-shaping light exiting the light source;

a second lighting unit comprising a second light source and a primary optical unit for pre-shaping the light exiting the second light source;

a secondary optical unit for imaging the light exiting the primary optical unit of the first lighting unit in a region in front of the vehicle as a first light distribution and the light exiting the primary optical unit of the second lighting unit as a second light distribution;

an actuator for actuating the first lighting unit and the second lighting unit in order to generate the light distribution consisting of the first light distribution and the second light distribution;

a diaphragm with a diaphragm edge to produce a light-dark boundary in the first light distribution, wherein the primary optical unit of the first lighting unit and/or the second lighting unit comprises a plurality of light guide elements which are designed to be formed differently such that the light exiting the light guide elements is imaged into different sub-light distributions of the first light distribution or the second light distribution by the secondary optical unit, the secondary optical unit being paired with the first lighting unit and the second lighting unit, wherein each of the light guide elements of the primary optical unit of the first lighting unit has a light coupling surface on a side facing the light source and a light decoupling surface on a side facing away from the light source, wherein the light decoupling surface of each of the light guide elements is shaped such that the light decoupled from each of the light decoupling surfaces is decoupled in different directions, so that the light is imaged by the secondary optical unit to the different sub-light distributions of the first light distribution, and wherein each of the light guide elements of the primary optical unit of the second lighting unit has a light coupling surface on a side facing the second light source and the primary optical unit of the second lighting unit has a light decoupling surface on a side facing away from the second light source, the light decoupling surface being formed by a front of the diaphragm facing the secondary optical unit, wherein the light decoupling surface is shaped such that the light that is pre-shaped from a light deflection surface of each of the light guide elements is decoupled in different directions, so that the light is imaged by the-secondary optical unit to the different sub-light distributions of the second light distribution, wherein the light deflection surface of each of the light guide elements face the secondary optical unit and are angled differently from one another.

2. The projection headlight according to claim 1, wherein the primary optical unit of the first lighting unit and the primary optical unit of the second lighting unit and the diaphragm are connected to each other in one piece.

3. The projection headlight according to claim 1, wherein the secondary optical unit is formed as a single lens.

4. The projection headlight according to claim 3, wherein the lens is formed as a converging lens with a single optical axis.

5. The projection headlight according to claim 1, wherein the primary optical unit of the first lighting unit and the second lighting unit and the diaphragm form a common structural unit produced by injection molding.

6. The projection headlight according to claim 5, wherein the diaphragm is connected to the primary optical unit of the first lighting unit and the second lighting unit by overmolding the same.

7. The projection headlight according to claim 1, wherein an extension of the primary optical unit of the first lighting unit and/or the second lighting unit in a main beam direction is less than half an extension of the diaphragm.

8. The projection headlight according to claim 1, wherein the diaphragm has a diaphragm edge forwardly disposed in a main beam direction, which is shaped so that the first light distribution has a predetermined light-dark boundary with exclusive actuation of the light sources of the first lighting unit.

9. The projection headlight according to claim 1, wherein the primary optical unit of the first lighting unit is designed such that via the secondary optical unit, the first light distribution is generated as a basic light distribution below a horizontal zero line, and that the primary optical unit of the second lighting unit is designed such that via the secondary optical unit, the second light distribution is generated as a range light distribution above the horizontal zero line.

10. The projection headlight according to claim 1, wherein the diaphragm is at least partially coated with a reflective material.

11. The projection headlight according to claim 1, wherein an optical axis of the light sources and the second light sources runs in the main beam direction.

12. The projection headlight according to claim 1, wherein the primary optical unit of the first lighting unit is arranged vertically above the primary optical unit of the second lighting unit.

* * * * *